US009157459B2

(12) United States Patent
Hasunuma et al.

(10) Patent No.: US 9,157,459 B2
(45) Date of Patent: Oct. 13, 2015

(54) LIQUID STORAGE CONTAINER

(71) Applicant: SURPASS INDUSTRY CO., LTD., Saitama (JP)

(72) Inventors: Masahiro Hasunuma, Saitama (JP); Takashi Imai, Saitama (JP)

(73) Assignee: SURPASS INDUSTRY CO., LTD., Saitama (JP)

( * ) Notice: Subject to any disclaimer, the term of this patent is extended or adjusted under 35 U.S.C. 154(b) by 265 days.

(21) Appl. No.: 13/659,965

(22) Filed: Oct. 25, 2012

(65) Prior Publication Data

US 2013/0112284 A1 May 9, 2013

(30) Foreign Application Priority Data

Oct. 31, 2011 (JP) ..... 2011-239616

(51) Int. Cl.

| | |
|---|---|
| ***B67D 7/72*** | (2010.01) |
| ***F04F 1/00*** | (2006.01) |
| ***F04F 1/18*** | (2006.01) |
| ***B65D 35/28*** | (2006.01) |
| ***F04F 10/00*** | (2006.01) |
| ***F16L 43/00*** | (2006.01) |
| *F04B 23/02* | (2006.01) |
| *F04B 43/00* | (2006.01) |

(52) U.S. Cl.

CPC ..... *F04F 10/00* (2013.01); *F04B 23/02* (2013.01); *F04B 43/0054* (2013.01); *Y10T 137/2802* (2015.04); *Y10T 137/2911* (2015.04); *Y10T 137/314* (2015.04); *Y10T 137/3115* (2015.04); *Y10T 137/3121* (2015.04); *Y10T 137/3127* (2015.04)

(58) Field of Classification Search

CPC ..... F04B 23/02; F04F 10/00
USPC ..... 137/136, 140, 145, 153, 206, 207.5, 137/209, 212; 222/95, 96, 105, 106, 107, 222/416

See application file for complete search history.

(56) References Cited

U.S. PATENT DOCUMENTS

| | | | | |
|---|---|---|---|---|
| 2,859,899 | A * | 11/1958 | Kramer et al. | 222/95 |
| 6,302,148 | B1 * | 10/2001 | Imai | 137/614.04 |
| 2012/0037625 | A1 | 2/2012 | Hasunuma et al. | |

FOREIGN PATENT DOCUMENTS

| | | | |
|---|---|---|---|
| JP | 8-48380 | A | 2/1996 |
| JP | 2001-192099 | A | 7/2001 |
| JP | 2007-297979 | A | 11/2007 |
| JP | 4713676 | | 6/2011 |

OTHER PUBLICATIONS

Japanese Office Action mailed Jul. 14, 2015, for Japanese Patent Application No. 2011-239616.

* cited by examiner

*Primary Examiner* — John K Fristoe, Jr.
*Assistant Examiner* — Kelsey Rohman
(74) *Attorney, Agent, or Firm* — Greenblum & Bernstein, P.L.C.

(57) ABSTRACT

A liquid storage container has a double structure provided with an outer container forming an outer shell and a liner arranged in the outer container, the liner accommodating a liquid, wherein the liquid is pushed out from the liner by gas pressure introduced into the outer container so as to flow out to an exterior of the container from a siphon of a plug attached to a stopper portion of the outer container, a substantially concentric drop tube is arranged on an outer periphery of the siphon so as to form a space portion serving as a liquid flow passage, a through hole is formed on a tube wall of the drop tube, and an outlet opening for making the inflow liquid coming from the through hole flow out from the liquid flow passage.

3 Claims, 7 Drawing Sheets

-- Prior Art --

LIQUID STORAGE CONTAINER

CROSS-REFERENCE TO RELATED APPLICATIONS

This application is based on Japanese Patent Application No. 2011-239616, the contents of which are incorporated herein by reference.

TECHNICAL FIELD

The present invention relates to a liquid storage container having a double structure provided with a flexible container accommodating a liquid, in which the liquid in the flexible container receiving external pressure is taken out to an exterior through a siphon.

BACKGROUND ART

In general, a liquid of a semiconductor highly pure chemical, a general chemical, or the like is charged into a liquid storage container such as a polyethylene tank in a production plant, and shipped in a state that a lid is attached to a stopper portion formed in this liquid storage container for charging and taking out. As a method of taking out the liquid accommodated in such a liquid storage container, there is a known siphon method of introducing a gas such as the air into the container so as to feed the liquid to an exterior of the container by gas pressure thereof.

In this siphon method, after the lid attached to the stopper portion of the liquid storage container is detached, a plug provided with a siphon serving as a liquid flow passage and a gas flow passage is attached. After that, by connecting a socket capable of being respectively coupled to a tube for taking out the liquid to the exterior of the liquid storage container and a tube for introducing the gas into the container to the plug, the liquid flow passage for taking out the liquid and the gas flow passage for introducing the gas are formed.

For example, as disclosed in the Publication of Japanese Patent No. 4713676, there is a liquid storage container adopting a double structure in which a flexible container accommodating a liquid is installed in an outer container. In such a liquid storage container having a double structure, the flexible container pushes out the inside liquid upon receiving external pressure. Thus, an amount (remaining amount) of the liquid which is left on a bottom surface of the container so as not to be taken out can be reduced.

In a conventional example of the liquid storage container having the double structure shown in FIG. 7, a liquid storage container 1 has a double structure provided with a flexible liner (flexible container) 2 and an outer container 3, and a plug 10 provided with a siphon 30 is attached to a stopper portion 4 of the outer container 3. At the time of taking out a liquid from the liquid storage container 1, a socket 50 is coupled to the plug 10, gas pressure (arrow P in the figure) is introduced into the outer container 3, and the liner 2 is pressed from the outside, so that the liquid accommodated in the liner 2 flows out to an exterior of the container from an ejection port 31 formed on the lower end side of the siphon 30 which is inserted into the liner 2 as if the liquid is pushed out. It should be noted that the reference sign 5 in the figure denotes a liner bracket to which the liner 2 is welded and attached.

SUMMARY OF INVENTION

Technical Problem

In the liquid storage container 1 having the double structure provided with the liner 2 accommodating the liquid, when the liner 2 receives the external pressure of the gas pressure P and the inside liquid is pushed out, for example as in a liner 2' shown by an imaginary line in FIG. 7, the inside liquid is almost gone, so that the liner is moved toward and pressed onto an outer surface of the siphon 30.

In a state that a remaining amount of the liquid in the liner 2 is decreased in such a way, there is a liquid generated and locked between the liner 2' and the outer surface of the siphon 30 or in a space formed by close gathering of the liner 2', and a liquid ball Lb is formed by this liquid. The liquid forming this liquid ball Lb cannot be taken out from the container through the siphon 30, and therefore unpreferably becomes a cause for increasing the final remaining amount of the liquid in the container.

From such a background, in the liquid storage container 1 having the double structure, there is a demand that even when the liner 2 receiving press of the gas is closely attached to the outer surface of the siphon 30, or even when the liner 2 closely gathers, the liquid ball Lb serving as the remaining liquid is not formed and the remaining amount of the liquid is furthermore reduced.

The present invention is achieved in consideration with the above situation, and an object thereof is to provide a liquid storage container having a double structure in which at the time of taking out a liquid, a liquid ball is not formed on an outer surface of a siphon or the like, so that a remaining amount of the liquid in a container is reduced.

Solution to Problem

In order to solve the above problem, the present invention adopts the following means.

A liquid storage container according to the present invention has a double structure provided with an outer container forming an outer shell and a flexible container arranged in the outer container, the flexible container accommodating a liquid, wherein the liquid is pushed out from the flexible container by gas pressure introduced into the outer container so as to flow out to an exterior of the container from a siphon of a plug attached to a stopper portion of the outer container, a substantially concentric outer tube is arranged on an outer periphery of the siphon so as to form a space portion serving as a liquid flow passage, a through hole is formed on a tube wall of the outer tube, and an outlet opening for making the inflow liquid coming from the through hole flow out from the liquid flow passage.

With such a liquid storage container, the substantially concentric outer tube is arranged on the outer periphery of the siphon so as to form the space portion serving as the liquid flow passage, the through hole is formed on the tube wall of the outer tube, and the outlet opening for making the inflow liquid coming from the through hole flow out from the liquid flow passage. Thereby, even in a state that the flexible container is moved toward the siphon and closely attached to an outer peripheral surface of the outer tube due to a decrease in a liquid amount, the liquid in the flexible container receiving the gas pressure flows out from the through hole to the liquid flow passage, flows down to the outlet opening, and at the end, flows out to the exterior of the container from the siphon.

In this case, a plurality of through holes formed on the tube wall of the outer tube may be arranged at an equal pitch in the axial direction and the circumferential direction of the outer tube, or arrangement of the through holes may be omitted in an upper part in the axial direction where there is no contact with the liquid in a state that the remaining amount of the liquid is small.

The outer tube and the through holes in this case contain a tubular body in which for example a part of a wall surface or the entire body is meshed.

In the above invention, the outlet opening may be formed in an outer tube retaining member inserted into and attached to the liquid flow passage from a lower end of the outer tube which is shorter than the siphon. Thereby, while maintaining the lower end of the outer tube in a stabilized state, the outlet opening for the inflow liquid from the through hole to the liquid flow passage can be ensured.

In the above invention, the outlet opening may be formed between a lower end of the outer tube which is longer than the siphon and a liquid receiving tray attached to the lower end. Thereby, the inflow liquid from the through hole to the liquid flow passage once flows down to the liquid receiving tray, and then flows into an inlet of the siphon from the outlet opening formed between the lower end of the outer tube and the liquid receiving tray.

Advantageous Effects of Invention

According to the present invention described above, in the liquid storage container having the double structure provided with the flexible container accommodating the liquid, in a case where the flexible container receiving press of a gas is moved toward the siphon and closely attached to an outer surface of the outer tube in a state that the remaining amount of the liquid is small, or even in a case where the flexible container closely gathers, the liquid has an outflow route for flowing from the through hole of the outer tube into the liquid flow passage. Thus, the liquid whose remaining amount is small can be prevented or suppressed from becoming a liquid ball and remaining in the flexible container. Such prevention of formation of the liquid ball exerts a remarkable effect for reducing the remaining amount of the liquid such as a valuable chemical solution which is left in the flexible container.

DESCRIPTION OF EMBODIMENTS

Hereinafter, one embodiment of a liquid storage container according to the present invention will be described based on the drawings.

Figure 6:
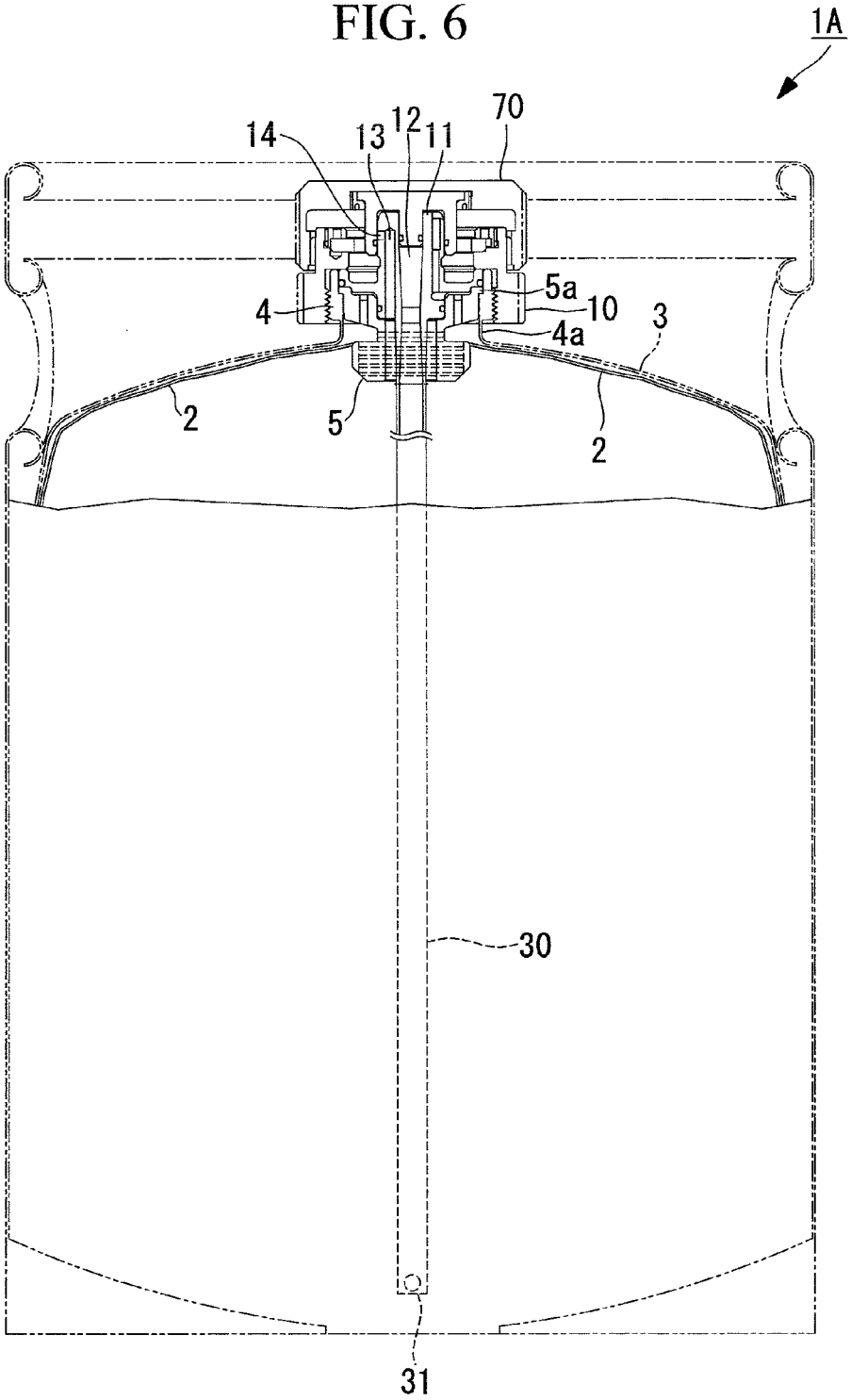
FIG. 6 is a front view serving as a partially sectional view, showing an entire configuration example of the liquid storage container.
Figure 7:
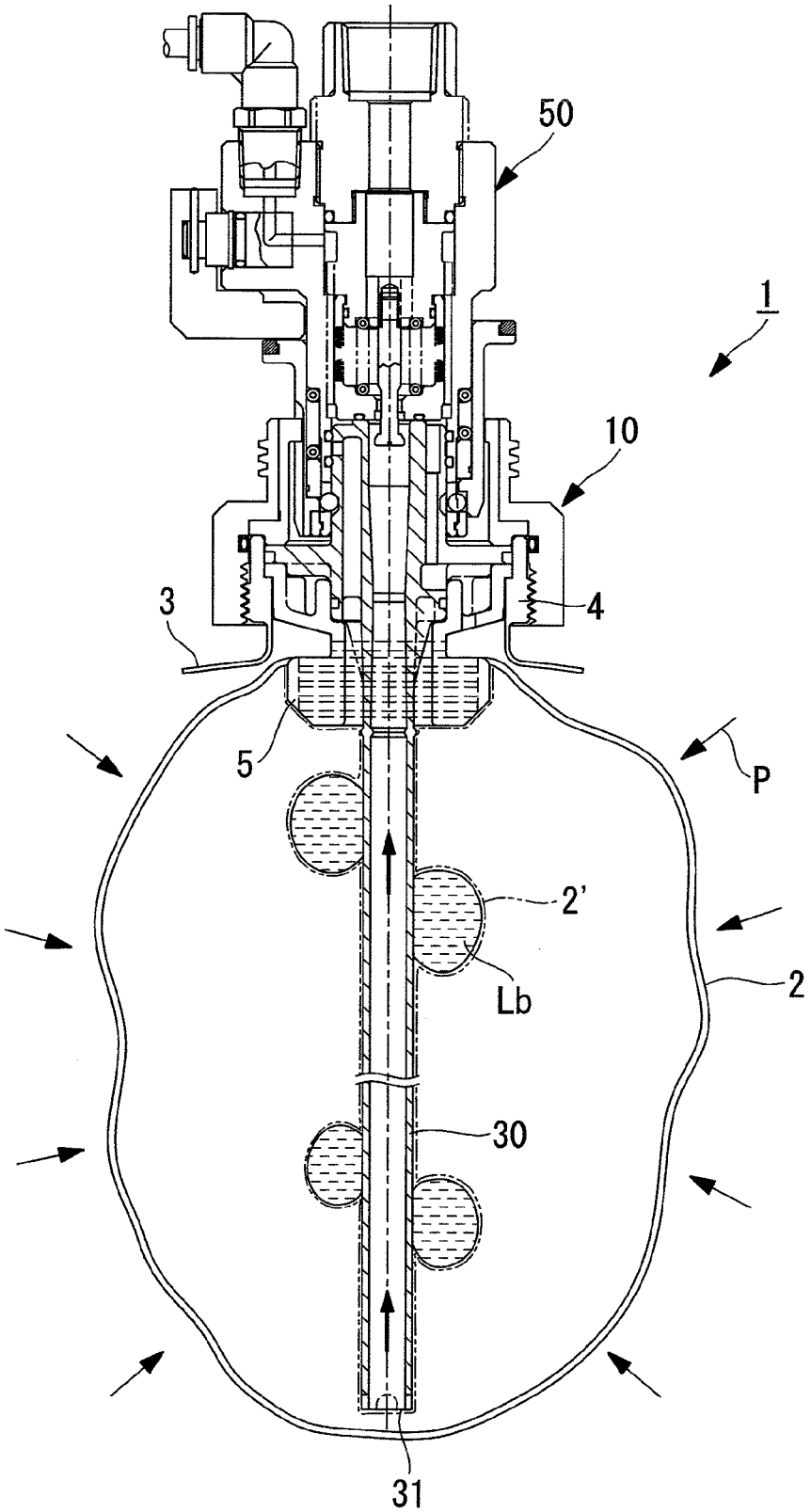
FIG. 7 is a sectional view of major parts showing a conventional structure of a liquid storage container.

A liquid storage container 1A of the embodiment shown in FIG. 6 is provided with a flexible liner (flexible container) 2 and an outer container 3. That is, the liquid storage container 1A has a double structure provided with the outer container 3 forming an outer shell and the liner 2 arranged in this outer container 3, the liner accommodating a liquid. The liquid accommodated in the liner 2 is pushed out from the liner 2 by gas pressure introduced into the outer container 3, so as to flow out to an exterior of the container from a siphon (liquid output tube) 30 of a plug 10 attached to a stopper portion 4 of the outer container 3.

Figure 1A:
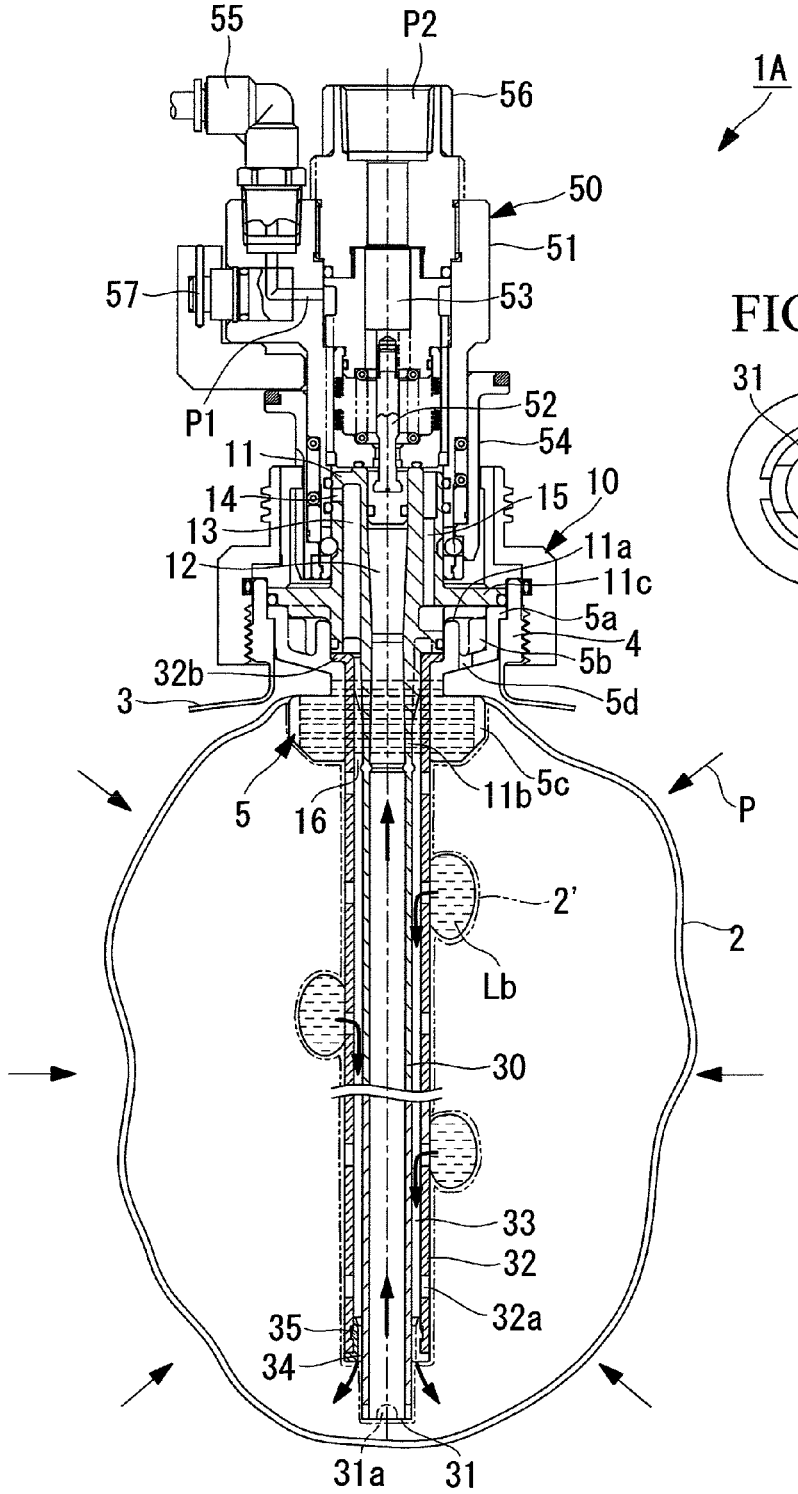
FIG. 1A is a sectional view of major parts showing a configuration example of a siphon and an outer tube, the view showing one embodiment of a liquid storage container according to the present invention.

It should be noted that although a lid 70 for sealing the container is attached to the plug 10 shown in the figure, at the time of taking out the liquid to the exterior of the container, the lid 70 is detached and a socket 50 shown in FIG. 1A is connected.

The liner 2 includes a bag body of a flexible film formed of an inactive material, and a liner bracket 5 made of relatively hard synthetic resin, and assembled into the plug 10 via the liner bracket 5.

The liner bracket 5 is welded to an end of the bag body of the flexible film. The liner 2 is preliminarily cleaned, and accommodated in the outer container 3. After the liquid is discharged from the liner 2, the liner 2 is disposed together with the liner bracket 5, and a liner 2 is accommodated in the outer container 3 together with a new liner bracket 5.

The outer container 3 is for example an aluminum can. By supporting the liner bracket 5 with an outer container opening portion 4*a* of the outer container 3, the liner 2 is accommodated in the outer container 3. A male screw is formed on an outer wall of the outer container opening portion 4*a*. The outer container 3 is a multiple storage type container which is repeatedly used, and in which, for every time, a new liner 2 is accommodated.

A liner bracket flange portion 5*a* is formed in the liner bracket 5, and a level difference is provided on an inner wall of the outer container opening portion 4*a*. By locking the liner bracket flange portion 5*a* onto the level difference provided on the inner wall of the outer container opening portion 4*a*, the liner bracket 5 is supported by the outer container opening portion 4*a*.

After the liner 2 is accommodated in the outer container 3 and the liner bracket 5 is supported by the outer container opening portion 4*a*, the liner 2 is expanded by preferably nitrogen or compressed air. After the liner 2 is expanded, the liquid is charged into the liner 2 from a liquid flow passage 12 and a siphon 30 described later.

As shown in FIG. 1A, the liner bracket 5 is formed in a substantially cylindrical shape. In the substantially cylindrical liner bracket 5, a substantially center part in the axial direction of an outer wall thereof is depressed. In the liner bracket 5, a part on the upper side of the depression of the substantially center part serves as an upper liner bracket 5*b*, and a part on the lower side serves as a lower liner bracket 5*c*. As shown in FIG. 1A, the end of the bag body of the flexible film is welded to the lower liner bracket 5*c*.

The liner bracket flange portion 5*a* is formed in an edge part on an upper surface of the upper liner bracket 5*b*. An outer diameter of the upper liner bracket 5*b* is slightly smaller than an inner diameter of the outer container opening portion 4*a*.

The liner bracket flange portion 5*a* is slightly bulged upward from the upper surface of the upper liner bracket 5*b*. Therefore, since a plug flange portion 11*a* described later is supported by the liner bracket flange portion 5*a*, a gap is formed between the upper surface of the upper liner bracket 5*b* and a lower surface of a plug flange portion 11*c*.

A level difference is formed on an inner wall of an opening of the substantially cylindrical upper liner bracket 5*b*. A lower part of a plug cylindrical portion 11 is inserted into the level difference formed on the inner wall of the opening. A plurality of liner bracket fluid flow passages 5*d* is provided on a circumference of the opening of the upper liner bracket 5*b* at a substantially equal interval. The plurality of (for example, four) liner bracket fluid flow passages 5*d* is provided in the axial direction of the upper liner bracket 5*b* so as to pass through the upper liner bracket 5*b*. The liner bracket fluid flow passages 5*d* communicate with an internal space between the outer container 3 and the liner 2 (refer to FIG. 1A).

The plug 10 is provided with the liquid flow passage 12 communicating with the liquid in the liner 2 so as to supply the liquid in the liner 2, and a gas flow passage 13 communicating with the gas in the liner 2 so as to supply the gas in the liner 2 in the cylindrical plug cylindrical portion 11 serving as a plug main body. An opening 14 formed on an outer wall so as to communicate with the gas flow passage 13 is also provided in the plug cylindrical portion 11.

The plug cylindrical portion 11 has a fluid flow passage 15 providing communication between the outer container 3 and the liner 2 so as to supply a fluid between the outer container 3 and the liner 2. This fluid flow passage 15 is provided with a stopcock 57 described later as a fluid flow passage sealing cancellation means for cancelling sealing.

The plug cylindrical portion 11 has the plug flange portion 11*a* protruding in the radial direction from a substantial center in the axial direction of the substantially cylindrical plug cylindrical portion 11.

The plug cylindrical portion 11 is supported by the liner bracket flange portion 5*a* via the plug flange portion 11*a* from the lower side. Thereby, the plug 10 is retained by the outer container opening portion 4*a*. An O ring is attached between the plug flange portion 11*a* and the liner bracket flange portion 5*a*. Thereby, the outer container opening portion 4*a* is tightly sealed.

In the plug cylindrical portion 11, a plug protruding portion 11*b* protruding from a cylindrical bottom surface thereof toward a bottom part of the liner 2 (refer to FIG. 1A) is provided. The liquid flow passage 12 passes through a center part of the plug cylindrical portion 11 and the plug protruding portion 11*b* in the axial direction thereof.

The plug cylindrical portion 11 on the lower side of the plug flange portion 11*a* is inserted into the opening of the upper liner bracket 5*b*. The plug cylindrical portion 11 inserted into the opening of the upper liner bracket 5*b* is locked onto the level difference provided on the inner wall of the opening. An O ring is attached between the outer wall of the plug cylindrical portion 11 and the inner wall of the opening of the upper liner bracket 5*b*. Since this O ring is closely attached to the outer wall in a lower part of the plug cylindrical portion 11, inflow of a pressurizing gas to the liner 2 is prevented, and outflow of the liquid in the liner 2 is prevented.

Since the plug protruding portion 11*b* is inserted from the upper side of the opening of the upper liner bracket 5*b*, an annular flow passage 16 is formed between the plug protruding portion 11*b* and an inner wall of an opening of the lower liner bracket 5*c*. This annular flow passage 16 communicates with the gas flow passage 13 provided in the plug cylindrical portion 11. Thereby, the gas in the liner 2 is supplied from the annular flow passage 16 through the gas flow passage 13.

The siphon 30 is welded to an extended end of the plug protruding portion 11*b*. As shown in FIG. 1A, the siphon 30 extends from the opening of the lower liner bracket 5*c* to a vicinity of the bottom part in the liner 2. The liquid in the liner 2 is supplied from the siphon 30 through the liquid flow passage 12. At this time, in order not to leave the remaining liquid in the flexible liner 2, the siphon 30 is desirably as long as possible within a range that the siphon is not in contact with the outer container 3.

As a shape of a front end of the siphon 30, in order not to bring an entire periphery of the front end serving as an ejection port 31 into contact with the liner 2, a plurality of holes 31*a* of an arc shape or the like is provided on a side wall thereof. By providing such a plurality of holes 31*a* on the side wall, an effective area for supplying a chemical solution (liquid) is increased. Thus, when the liner 2 is shrunk, the holes 31*a* are not completely closed, so that the chemical solution can be supplied. Therefore, the remaining liquid in the liner 2 can be decreased.

It should be noted that in a case where the front end of the siphon 30 is cut obliquely with respect to the axial direction, the effective area can be increased. However, there is a fear that the flexible liner 2 is broken.

At the time of taking out and distributing the liquid in the liner 2, the lid 70 is removed from and the socket 50 is connected to the plug 10 described above. FIG. 1A shows a state that the socket 50 is inserted into the plug 10 and connection between the plug 10 and the socket 50 is completed.

By inserting the socket 50 into the plug 10, a valve mechanism 52 provided in a socket main body 51 is brought into an opened state, so that distribution can be performed through a valve mechanism liquid flow passage 53 formed in the valve mechanism 52. A sleeve 54 is locked onto the plug cylindrical portion 11. Thus, the siphon 30, the liquid flow passage 12, and the valve mechanism liquid flow passage 53 are directly connected so as to receive the liquid divided from the liner 2.

When the fluid such as the gas is introduced from a liner pressurizing connection portion 55 provided in the socket main body 51 and external pressure is supplied, this external pressure is guided from the liner pressurizing connection portion 55 to a supply port P1 formed in the socket main body 51. In the socket 50 whose insertion into the plug 10 is completed, the supply port P1 communicates with the fluid flow passage 15 via a flow passage formed in the valve mechanism 52. Thus, the external pressure guided to the fluid flow passage 15 is guided to the gap formed between the upper surface of the upper liner bracket 5*b* and the lower surface of the plug flange portion 11*c*. The external pressure guided to the gap is guided to an internal space between the outer container 3 and the liner 2 from the liner bracket fluid flow passages 5*d* provided in the upper liner bracket 5*b*.

The external pressure guided to the internal space is applied to the liner 2. Therefore, the liquid in the liner 2 is guided from the siphon 30 to the liquid flow passage 12. Since the valve mechanism 52 provided in the socket main body 51 is in an opened state, the liquid guided to the liquid flow passage 12 is supplied from a discharge port P2 provided in a discharge port member 56 through the valve mechanism liquid flow passage 53.

At the time of taking out the socket 50 from the plug 10, the external pressure supplied from the liner pressurizing connection portion 55 is stopped. After this, when the stopcock 57 provided in the socket main body 51 is turned and opened, the external pressure in the supply port P1 is discharged (supplied) to an exterior of the port. At the same time, in the flow passage formed in the valve mechanism 52, in the fluid flow passage 15 of the plug cylindrical portion 11, and in the internal space between the outer container 3 and the liner 2, gas pressure applied as the external pressure is released to an atmosphere, so that the pressure immediately corresponds to atmospheric pressure.

In such a liquid storage container 1, with the configuration of the present embodiment shown in FIG. 1A, a substantially concentric drop tube (outer tube) 32 is arranged on an outer periphery of the siphon 30 inserted into the liner 2, so that a space portion serving as a liquid flow passage 33 is formed. Further, through holes 32*a* are formed on a tube wall of the drop tube 32, and an outlet opening 34 for making the inflow liquid coming from the through holes 32*a* flow out from the liquid flow passage 33 is provided.

That is, in the present embodiment, in order to form the liquid flow passage 33 on the outer side of the siphon 30, a double tube structure in which a gap is provided on the outer side of the siphon 30 and the drop tube 32 is substantially concentrically arranged is provided, and the through holes 32*a* are appropriately formed in the drop tube 32 on the outer side. Thus, formation of a liquid ball Lb is prevented.

The drop tube 32 shown in the figure has length that the lower end side is slightly shorter than the siphon 30, and a flange portion 32*b* provided in an upper end is disposed in a recessed part of the liner bracket 5 and pressed by the plug 10 inserted from the upper side.

The plurality of through holes 32*a* formed on the tube wall of the drop tube 32 is provided at an equal pitch in the axial direction and the circumferential direction of the drop tube 32. For example, four through holes 32*a* may be formed at a pitch of 90 degrees in the circumferential direction and plural rows of the through holes may be arranged in the axial direction. However, arrangement and the number of the through holes 32*a* are not particularly limited as long as the formation of the liquid ball Lb can be prevented. For example, the through holes may be arranged in a zigzag manner, or the arrangement of the through holes may be omitted in an upper part in the axial direction where there is no contact with the liquid in a state that a remaining amount of the liquid is small.

The outlet opening 34 is provided by inserting a ring shape drop adapter (outer tube retaining member) 35 into the liquid flow passage 33 from a lower end of the drop tube 32 which is shorter than the siphon 30 and forming a slit or a through hole in the axial direction in this drop adapter 35. That is, the drop adapter 35 inserted from the lower end of the drop tube 32 forms the outlet opening 34 and maintains the lower end side in a stabilized state.

Figure 1B:
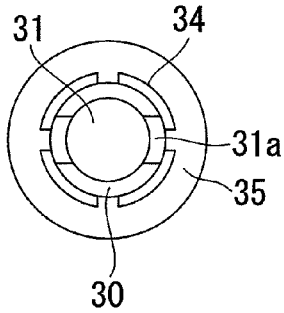
FIG. 1B is a bottom view of the siphon and the outer tube, the view showing one embodiment of the liquid storage container according to the present invention.

It should be noted that although the outlet opening 34 in this case is formed over the substantially entire periphery while dividing into four in the circumferential direction for example as shown in FIG. 1B, the outlet opening is not particularly limited.

With the liquid storage container 1 formed in such a way, the substantially concentric drop tube 32 is arranged on the outer periphery of the siphon 30 so as to form the space portion serving as the liquid flow passage 33, and the inflow liquid coming from the through holes 32*a* formed on the tube wall of the drop tube 32 flows into the liquid flow passage 33 and flows out from the outlet opening 34. As a result, when the pressurizing fluid is introduced from the liner pressurizing connection portion 55 and gas pressure P is applied in order to take out the liquid from the liner 2, the liner 2 receiving this gas pressure P is pushed toward the siphon 30 as an inside liquid amount is decreased, and closely attached to an outer peripheral surface of the drop tube 32.

However, since the through holes 32*a* are formed in the drop tube 32, the liquid whose remaining amount is small flows out from the through holes 32*a* to the liquid flow passage 33 and flows down to the outlet opening 34.

The liquid dropped to the outlet opening 34 in such a way flows out to the exterior of the container from the ejection port 31 of the siphon 30. That is, the through holes 32*a* communicating with the ejection port 31 of the siphon 30 through the liquid flow passage 33 and the outlet opening 34 so as to reliably make the liquid whose remaining amount is small flow out from liner 2 are provided in the drop tube 32 to which the liner 2 is closely attached. Thus, a fluid discharge route is formed in an outer peripheral part of the siphon 30, and therefore, an amount of the liquid which is left in the liner 2 of the liquid storage container 1 so as not to be taken out can be reduced or eliminated.

The drop tube 32 described above more reliably reduces the remaining amount of the liquid. Thus, desirably, a large number of through holes 32*a* are arranged substantially evenly over the entire periphery. Particularly, in a state that the remaining amount of the liquid in the liner 2 is small, a liquid level is lowered. Thus, a large number of through holes 32*a* may be arranged on the lower side of the drop tube 32.

The drop tube 32 and the through holes 32*a* in this case may be a tubular body in which for example a part of a wall surface (particularly the lower end side) or the entire body is meshed.

Figure 2:
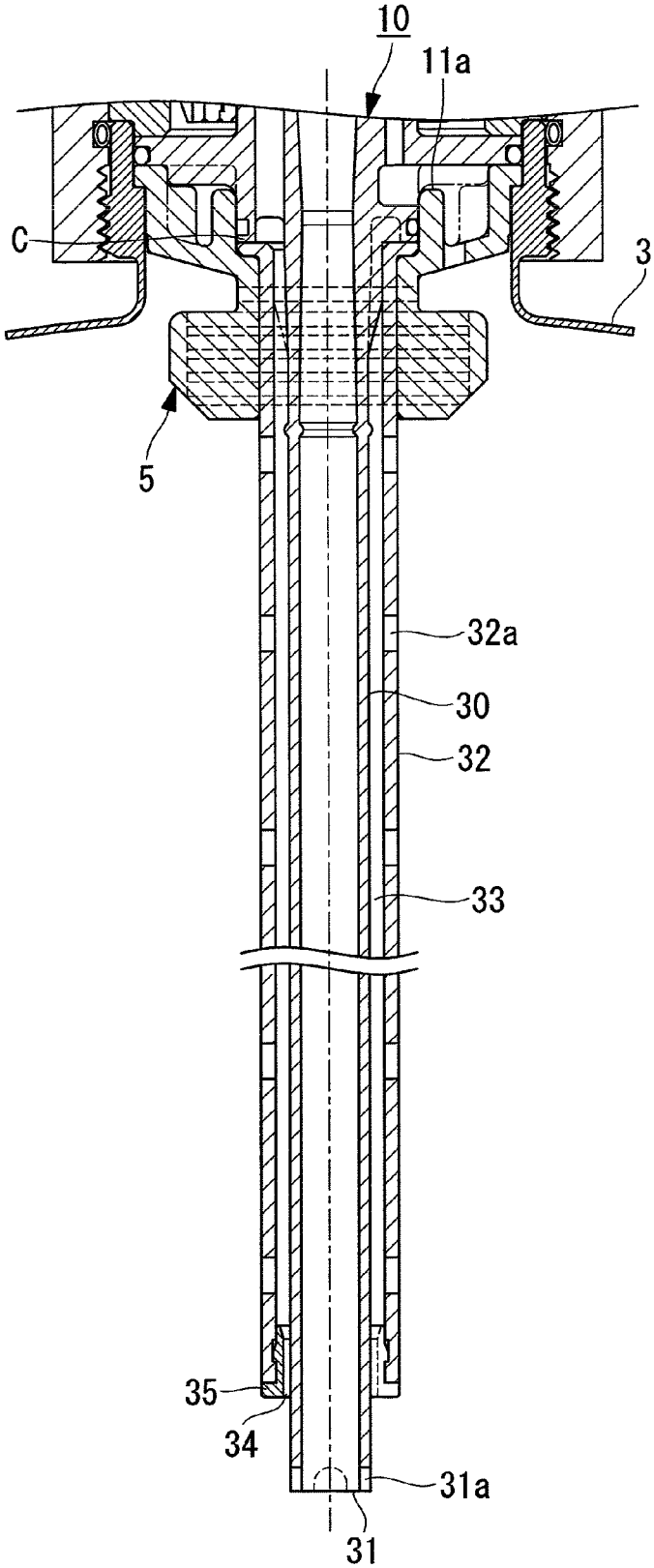
FIG. 2 is a sectional view of major parts showing a configuration example of the siphon and the outer tube, the view showing a first modification of the liquid storage container shown in FIG. 1A.

In the embodiment described above, the drop tube 32 disposed in the recessed part of the liner bracket 5 is pressed by the plug 10. However, for example as in a first modification shown in FIG. 2, a structure that the drop tube is combined with the plug 10 at a coupling portion C by bonding or the like so as to be integrated may be adopted. It should be noted that the liner 2 and the like are not shown in the figures in the first modification and modifications described below.

Figure 3:
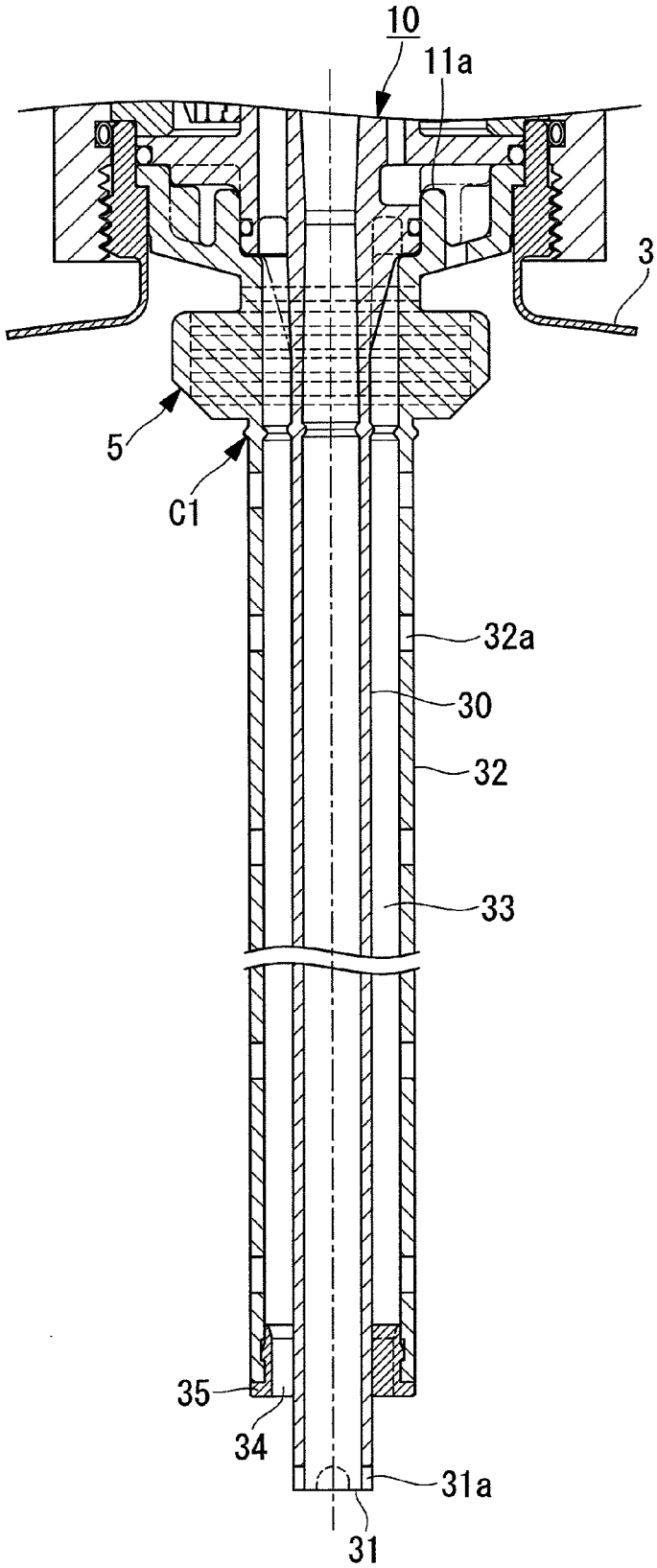
FIG. 3 is a sectional view of major parts showing a configuration example of the siphon and the outer tube, the view showing a second modification of the liquid storage container shown in FIG. 1A.

As in a second modification shown in FIG. 3, a structure that the drop tube is welded to the liner bracket 5 at a coupling portion C1 so as to be integrated may be adopted.

Figure 4:
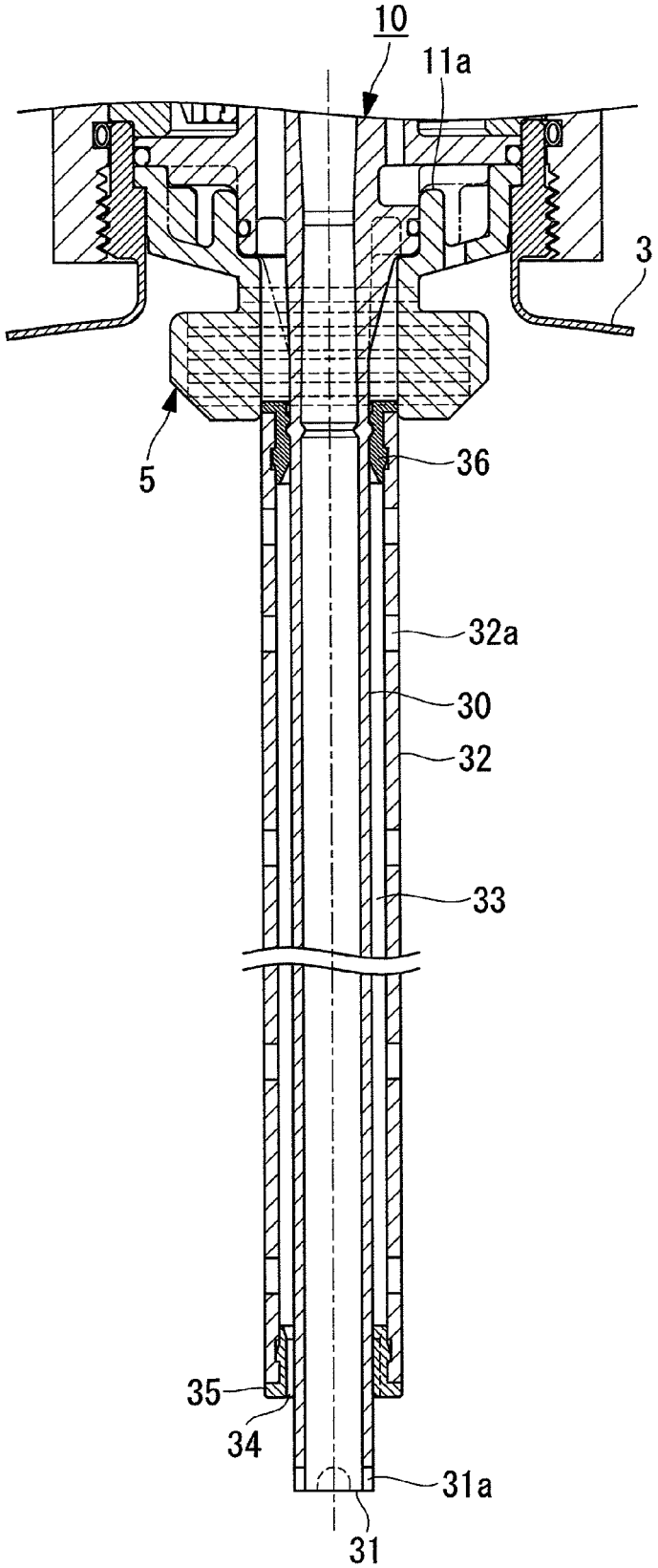
FIG. 4 is a sectional view of major parts showing a configuration example of the siphon and the outer tube, the view showing a third modification of the liquid storage container shown in FIG. 1A.

Further, as in a third modification shown in FIG. 4, a structure that an upper end of the drop tube 32 is press-fitted to the outer periphery of the siphon 30 with using an adapter 36 may be adopted.

In such a way, the drop tube 32 may be arranged on the outer periphery of the siphon 30 and fixed by a certain means.

Figure 5:
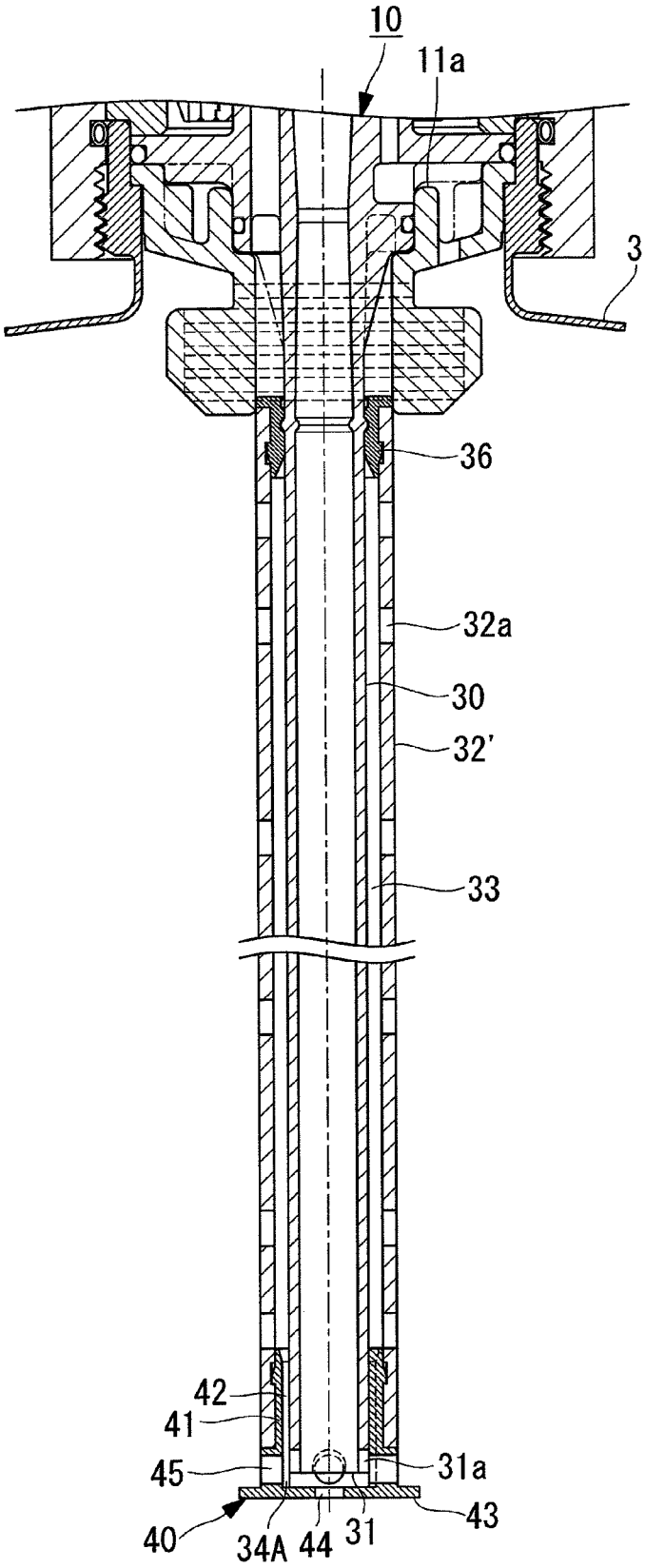
FIG. 5 is a sectional view of major parts showing a configuration example of the siphon and the outer tube, as a fourth modification of the liquid storage container shown in FIG. 1A.

In a fourth modification shown in FIG. 5, an outlet opening 34A is formed between a lower end of a drop tube 32' which is longer than the siphon 30 and a liquid receiving tray 40 attached to the lower end. This liquid receiving tray 40 is press-fitted and attached from the lower end of the drop tube 32' for example. A slit 42 forming the outlet opening 34A communicating with the liquid flow passage 33 is provided in a substantially tubular press-fit portion 41.

Further, the liquid receiving tray 40 is provided with a liquid introduction hole 44 formed in a center part or the like of a circular receiving tray portion 43, and a liquid introduction flow passage 45 passing through a wall surface of the press-fit portion 41. It should be noted that a gap portion or a cutout portion forming a liquid flow passage is provided between the lower end of the siphon 30 and the liquid receiving tray 40.

With such a configuration, the inflow liquid coming from the through holes 32*a* to the liquid flow passage 33 once flows down to the liquid receiving tray 40, and then flows into the ejection port 31 serving as an inlet of the siphon 30 from the outlet opening 34A formed between the lower end of the drop tube 32' and the liquid receiving tray 40.

It should be noted that although the fixing structure of the siphon 30 shown in the third modification is adopted in the fourth modification shown in the figure, the present invention is not limited to this.

As described above, according to the present embodiment and the modifications thereof, in the liquid storage container 1 having the double structure provided with the liner 2 accommodating the liquid, even when the liner 2 receiving the press of the gas in a state that the remaining amount of the liquid is small is moved toward the siphon 30, close attachment to the siphon 30 or close gathering of the liner 2 can be prevented by the drop tube 32 provided with the through holes 32*a*. That is, the liquid whose remaining amount is small in the liner 2 has an outflow route for flowing from the through holes 32*a* into the liquid flow passage 33. Thus, the liquid whose remaining amount is small can be prevented or suppressed from becoming the liquid ball Lb and remaining in the liner 2.

Therefore, by preventing the formation of the liquid ball described above, for the liquid such as a valuable chemical solution accommodated in the liquid storage container 1, the remaining amount of the liquid which is left in the liner 2 so as not to be taken out from the container can be reduced.

It should be noted that the present invention is not limited to the embodiment described above but can be appropriately changed within a range not departing from the gist thereof.

REFERENCE SIGNS LIST

1, 1A Liquid storage container
2 Liner (flexible container)
3 Outer container
4 Stopper portion
10 Plug
11 Plug cylindrical portion
12 Liquid flow passage
13 Gas flow passage
14 Opening
15 Fluid flow passage
16 Annular flow passage
30 Siphon (liquid output tube)
31 Ejection port
32, 32' Drop tube (outer tube)
32*a* Through hole
33 Liquid flow passage
34, 34A Outlet opening
35 Drop adapter
36 Adapter
40 Liquid receiving tray
50 Socket
Lb Liquid ball

The invention claimed is:

1. A liquid storage container having a double structure provided with an outer container forming an outer shell and a flexible container arranged in the outer container, the flexible container accommodating a liquid, wherein the liquid is pushed out from the flexible container by gas pressure introduced into the outer container so as to flow out to an exterior of the container from a siphon of a plug attached to a stopper portion of the outer container, a substantially concentric outer tube is arranged on an outer periphery of the siphon so as to form a space portion serving as a liquid flow passage, a through hole is formed on a tube wall of the outer tube, an outlet opening is provided for making the inflow liquid coming from the through hole flow out from the liquid flow passage, and the outlet opening is formed in an outer tube retaining member inserted into and attached to the liquid flow passage from a lower end of the outer tube.

2. The liquid storage container according to claim 1, wherein the outer tube is shorter than the siphon.

3. The liquid storage container according to claim 1, wherein the outer tube is longer than the siphon, and wherein a liquid receiving tray attached to the lower end has a press-fit portion which is the outer tube retaining member.

* * * * *